US009914160B2

(12) United States Patent
Wright et al.

(10) Patent No.: US 9,914,160 B2
(45) Date of Patent: Mar. 13, 2018

(54) METHODS FOR FORMING A WORK ROLL AND A DULLED GLOSS FINISH ON A METAL SUBSTRATE

(71) Applicant: NOVELIS INC., Atlanta, GA (US)

(72) Inventors: David Skingley Wright, Rosdorf-Dramfeld (DE); Franz Josef Rawe, Attendorn (DE)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 15/683,139

(22) Filed: Aug. 22, 2017

(65) Prior Publication Data

US 2017/0348744 A1 Dec. 7, 2017

Related U.S. Application Data

(62) Division of application No. 14/204,331, filed on Mar. 11, 2014.

(60) Provisional application No. 61/788,637, filed on Mar. 15, 2013.

(51) Int. Cl.

| | |
|---|---|
| ***B21B 27/00*** | (2006.01) |
| ***B21B 27/02*** | (2006.01) |
| ***B21B 1/22*** | (2006.01) |
| *B21B 3/00* | (2006.01) |
| *B41N 1/08* | (2006.01) |

(52) U.S. Cl.

CPC ..... *B21B 27/005* (2013.01); *B21B 1/227* (2013.01); *B21B 27/02* (2013.01); *B21B 2003/001* (2013.01); *B21B 2261/14* (2013.01); *B21B 2267/065* (2013.01); *B41N 1/083* (2013.01); *Y10T 29/4956* (2015.01); *Y10T 428/12993* (2015.01)

(58) Field of Classification Search

CPC ..... B21B 2001/081; B21B 2267/10; B21B 2023/005; B29C 2043/461; B29C 2043/463; Y10T 29/49544; Y10T 29/4956

See application file for complete search history.

(56) References Cited

U.S. PATENT DOCUMENTS

| | | | | |
|---|---|---|---|---|
| 2,059,384 | A | 11/1936 | Montgomery et al. | |
| 3,705,451 | A | 12/1972 | Harold | |
| 3,869,535 | A | 3/1975 | Coll | |
| 4,850,089 | A | 7/1989 | Monfort et al. | |
| 5,508,119 | A | 4/1996 | Sheu et al. | |
| 5,537,851 | A | 7/1996 | Sheu et al. | |
| 5,554,235 | A | 9/1996 | Noe et al. | |
| 6,220,940 | B1 | 4/2001 | Johnson | |
| 6,290,632 | B1 * | 9/2001 | Blake | B21B 1/227 492/54 |
| 6,367,151 | B1 | 4/2002 | Schlegel et al. | |
| 6,527,628 | B2 | 3/2003 | Ito et al. | |
| 6,807,836 | B2 * | 10/2004 | Sambuco, Jr. | B24B 1/00 72/236 |
| 6,971,946 | B2 | 12/2005 | Suzuki | |
| 7,571,542 | B2 * | 8/2009 | Nishino | C25D 5/36 29/895 |
| 2003/0173704 | A1 | 9/2003 | Cameron | |
| 2004/0112104 | A1 * | 6/2004 | Scamans | B21B 1/227 72/187 |
| 2005/0081592 | A1 | 4/2005 | Sambuco et al. | |
| 2005/0118452 | A1 | 6/2005 | Nishino et al. | |
| 2005/0227594 | A1 | 10/2005 | Vinke et al. | |
| 2005/0258136 | A1 | 11/2005 | Kawanishi et al. | |
| 2010/0321783 | A1 | 12/2010 | Hirabayashi et al. | |
| 2013/0273394 | A1 | 10/2013 | Sheu et al. | |
| 2014/0060700 | A1 | 3/2014 | Sheu et al. | |
| 2014/0272466 | A1 | 9/2014 | Wright et al. | |
| 2017/0165728 | A1 | 6/2017 | Xavier et al. | |

FOREIGN PATENT DOCUMENTS

| | | |
|---|---|---|
| GB | 1293576 | 10/1972 |
| GB | 1326809 | 8/1973 |
| GB | 1486321 | 9/1977 |
| JP | 04046607 | 2/1992 |
| JP | H0441003 | 2/1992 |
| JP | H04210803 | 7/1992 |
| JP | H052501 | 1/1993 |
| JP | 05069014 | 3/1993 |
| JP | 05123704 | 5/1993 |
| JP | 06335707 | 12/1994 |
| JP | H0852501 | 2/1996 |
| JP | 11285705 | 10/1999 |
| JP | 2002282902 | 10/2002 |
| JP | 2005246432 | 9/2005 |
| JP | 2009083190 | 4/2009 |

(Continued)

OTHER PUBLICATIONS

Original Japanese and English Machine Translation of JPH0852501A, Iizuka et al., Feb. 27, 1996.*
U.S. Appl. No. 14/204,331, "Advisory Action", dated Jul. 3, 2017, 5 pages.
U.S. Appl. No. 14/204,331, "Final Office Action", dated Apr. 24, 2017, 10 pages.
U.S. Appl. No. 14/204,331, "Non-Final Office Action", dated Jul. 27, 2016, 9 pages.
U.S. Appl. No. 14/204,331, "Restriction Requirement", dated Mar. 25, 2016, 7 pages.
CA 2,901,307, "Office Action", dated Oct. 17, 2016, 4 pages.
EP 14717558.2, "Office Action", dated Jun. 6, 2016, 4 pages.
EP 14717558.2, "Office Action", dated Oct. 23, 2015, 5 pages.
JP 2016-501169, "Office Action", dated Oct. 4, 2016, 5 pages.
JP 2016-501169, English Translation of Third Party Submission, dated Jul. 7, 2016, 4 pages.

(Continued)

*Primary Examiner* — Sarang Afzali
(74) *Attorney, Agent, or Firm* — Kilpatrick Townsend & Stockton LLP

(57) ABSTRACT

This application discloses methods of preparing a work roll for applying a dulled gloss finish on a metal substrate surface. The resulting finish has a fairly uniform glossiness with a slightly matted appearance and with minimal directionality. The work rolls have an Ra value of from 0.2 to 0.4 μm and an Rz value of less than 3.0 μm. Methods of forming a dulled gloss finish on a metal substrate are also described herein.

15 Claims, 11 Drawing Sheets

(56) References Cited

FOREIGN PATENT DOCUMENTS

| | | |
|---|---|---|
| WO | 02072290 | 9/2002 |
| WO | 2007076207 | 7/2007 |
| WO | 2013071114 | 5/2013 |
| WO | 2014074160 | 5/2014 |
| WO | 2017099957 | 6/2017 |

OTHER PUBLICATIONS

KR 10-2015-7029597, "Office Action", dated Nov. 10, 2016, 11 pages.
PCT/2014/023194, International Search Report & Written Opinion dated Jun. 11, 2014.
PCT/US2016/062087, "International Search Report and Written Opinion", dated Feb. 10, 2017, 12 pages.
Batalha et al., "Quantitative characterization of the surface topography of cold rolled sheets—New approaches and possibilities", Journal of Materials Processing Technology, vol. 113, Issue 1, Jun. 2001, pp. 732-738.
Franco et al., "3D surface parameters (ISO 25178-2): Actual meaning of Spk and its relationship to Vmp", Precision Engineering, vol. 40, Apr. 2015, pp. 106-111.
Pawelski et al., "The influence of different work-roll texturing systems on the development of surface structure in the temper rolling process of steel sheet used in the automotive industry", Journal of Materials Processing Technology, vol. 45, Issues 1-4, Sep. 1994, pp. 215-222.
Sedlaček et al., "Influence of surface preparation on roughness parameters, friction and wear", Wear, vol. 266, Issues 3-4, Feb. 5, 2009, pp. 482-487.
Skarpelos et al., "The effect of surface morphology on friction during forming of electrogalvanized sheet steel", Wear, vol. 212, Issue 2, Dec. 10, 1997, pp. 165-172.
Wentink et al., "A generic model for surface texture development, wear and roughness transfer in skin pass rolling", Wear, vols. 328-329, Apr. 15, 2015, pp. 167-176.
Zhou et al., "Effect of EDT surface texturing on tribological behavior of aluminum sheet", Journal of Materials Processing Technology, vol. 211, Issue 10, Oct. 2011, pp. 1643-1649.

* cited by examiner

METHODS FOR FORMING A WORK ROLL AND A DULLED GLOSS FINISH ON A METAL SUBSTRATE

PRIOR RELATED APPLICATIONS

This application is a divisional application of U.S. patent application Ser. No. 14/204,331, filed Mar. 11, 2014, which claims priority to U.S. Provisional Application No. 61/788,637, filed Mar. 15, 2013. These applications are incorporated herein by reference in their entireties.

FIELD OF THE INVENTION

The present invention provides rolled surfaces having a dulled gloss finish. The dulled gloss finish has a uniform glossiness with a slightly matted appearance and with minimal directionality.

BACKGROUND

Surface finishes having a smooth surface are desirable for many manufactured items. Reducing the roughness of a conventional ground surface takes a long time and leads to an extreme sensitivity to grinding imperfections, so that the product can only be made on specialized high-gloss mills. Any imperfection appears immediately and ruins the product impression. Also, a residual directionality is often left in the surface so that the product cannot easily be mixed with others at different directions.

A matted surface, on the other hand, tends to be rougher and to look very grey. For many applications, the roughness is too great. In addition, the surfaces are difficult to produce and dirty, since roughened rolls tend to plough the surface and leave large amounts of fines which hinder further processing unless cleaned. The smearing caused by relative speeds between strip and work roll tends to limit the reductions and speeds that can be used in manufacture. Otherwise, an unusable surface will result.

SUMMARY

The present invention solves these problems by providing rolled surfaces having a dulled gloss finish. The dulled gloss finish as described herein has a relatively uniform glossiness with a slightly matted appearance and with minimal directionality. The dulled gloss finish described herein combines the effect of an acceptable amount of gloss with the effect of uniform matting. By breaking off the roughness peaks on the roll and replacing them with a controlled smoothness, the product is not susceptible to smearing of the rough parameters and generating fines. The roughness also suppresses the tendency to be sensitive to minor imperfections in the gloss component. The surface is suitable for lithographic use and for can end use.

The surface of the work roll used for applying a dulled gloss finish on a metal substrate surface, as described herein, can have an Ra value of from 0.15 to 0.4 μm (e.g., from 0.20 to 0.4) and an Rz value of less than 3.0 μm. Optionally, the surface of the work roll has an Ra value of from 0.27 μm to 0.3 μm and an Rz value of less than 2.5 μm. The work roll can be a cold mill work roll.

A method of preparing a work roll for applying a dulled gloss finish on a metal substrate surface is also described herein. In one embodiment, the method includes the steps of roughening an unfinished work roll surface to form a roughened work roll surface, wherein the roughened work roll has an Ra of 0.20 μm or less and an Rz of 2.00 μm or less; polishing the roughened work roll surface to form a polished work roll surface having an Ra of less than 0.015 μm and an Rz of less than 0.25 μm; uniformly roughening the polished work roll surface to form a uniformly roughened work roll surface having an Ra of from 0.35 μm to 0.45 μm and an Rz of less than 5 μm; and finishing the uniformly roughened work roll surface to form a work roll surface, wherein the work roll surface has an Ra value of from 0.2 to 0.4 μm and an Rz value of less than 3.0 μm. Work rolls prepared according to this method are also described herein.

Further described herein are methods for forming a dulled gloss finish on a metal substrate. In one embodiment, the method includes the steps of roughening an unfinished work roll surface to form a roughened work roll surface, wherein the roughened work roll has an Ra of 0.20 μm or less and an Rz of 2.00 μm or less; polishing the roughened work roll surface to form a polished work roll surface having an Ra of less than 0.015 μm and an Rz of less than 0.25 μm; uniformly roughening the polished work roll surface to form a uniformly roughened work roll surface having an Ra of from 0.35 μm to 0.45 μm and an Rz of less than 5 μm; finishing the uniformly roughened work roll surface to form a work roll surface, wherein the work roll surface has an Ra value of from 0.2 to 0.4 μm and an Rz value of less than 3.0 μm; inserting the work roll in a cold mill; and cold rolling the metal substrate with the work roll to achieve the dulled gloss finish on the metal substrate. Optionally, the metal substrate can be aluminum or an aluminum alloy sheet. Optionally, the metal substrate can be a steel sheet.

DETAILED DESCRIPTION

The present invention solves these problems by providing a dulled gloss surface finish for rolled products. "Dulled gloss" finish, as used herein, refers to a finish having a relatively uniform glossiness with a slightly matted appearance. The dulled gloss finish can be characterized as having an appearance intermediate to that of a bright sheet finish (e.g., a foil-like finish) and a standard can stock finish. Optionally, the dulled gloss finish can be characterized as having a "satin-gloss" appearance. Optionally, the dulled gloss finish can be characterized as having a non-mirror like appearance. Also, the dulled gloss surface finish has minimum directionality when compared with a traditional rolled grit finish. The products having the dulled gloss surface finish described herein have a low level of roughness such that subsequent processing can be improved. For example, less lacquer is needed for coated products, such as can ends, and less customer material removal and processing (e.g., from lithography applications). Products prepared having the dulled gloss surface finish as described herein also exhibit eased manufacturability on standard rolling mills at high speeds and with large reductions in sheet thickness.

The formability of products prepared having the dulled gloss surface finish is improved over that of material with a standard metal with a "directional" surface. The products with improved formability prepared using the work rolls described herein are less prone to issues resulting from low formability, such as product cracking. Not to be bound by theory, this is due, in part, to the fact that the friction in direction 90° to the rolling direction is highest in the standard directional material. In the standard directional material, the forming loads are increased due to direct impingement from the topographical peaks created with a standard roll ground surface. In the products described herein, the number of peaks is lowered by at least 10% over the standard directional material. For example, the number of peaks can be lowered by at least 20%, at least 30%, at least 40%, at least 50%, at least 60%, at least 70%, at least 80%, at least 90%, or can be absent. Thus, the friction is balanced in all directions and the extreme loads from friction at the 90° component are lowered. Moreover, when a circular product, such as a can end, is formed from standard directional material, the resulting shape is not a perfect circle, but is "off-drawn" into a subtle elliptical shape with the largest diameter being in the 90° direction. This is a direct result of the higher friction (and hence higher forming load) in the 90° orientation. The operating window for forming can be widened with the surfaces described herein to manage the "off-drawn" phenomena.

Figure 1:
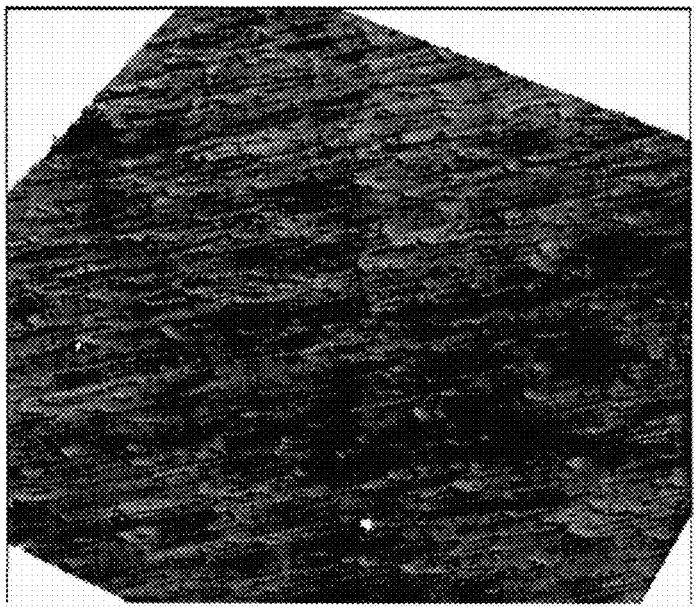
FIG. 1 is a picture showing the surface structure of the dulled gloss finish.
Figure 2:
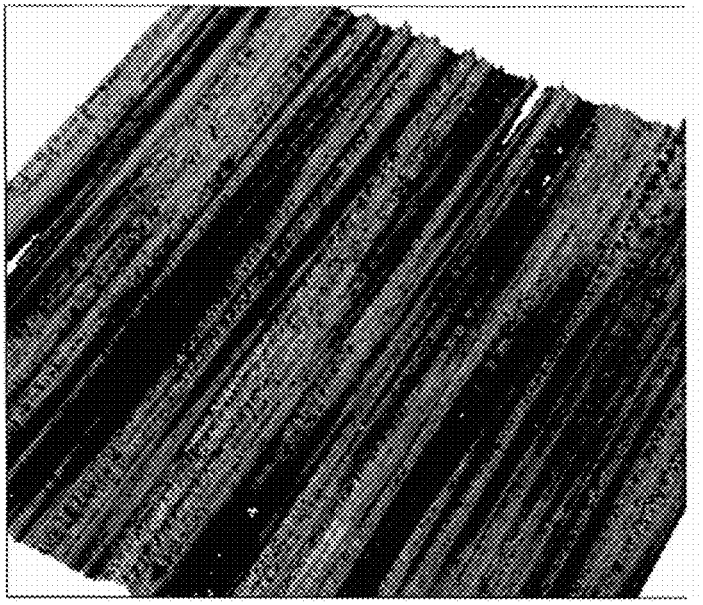
FIG. 2 is a picture showing the surface structure of the standard grit finish.

The dulled gloss surface finish, as described herein, has been developed to replace the rolled grit surface. A view of the surface structure of the dulled gloss finish is shown in FIG. 1, while a view of the surface structure of the rolled grit surface is shown in FIG. 2. The dulled gloss finish is desirable, for example, where more isotropy is required.

Method of Preparing Dulled Gloss Finish Work Roll

The work roll is made by smoothly finishing a roll before shot blasting it and subjecting it to a final polish. A roughened work roll for a rolling mill made, for example, by sandblasting, can be polished to smooth the upper peaks of the rough surface. The resulting sheet surface can contain a flattish base (i.e., a gloss) dulled by the residual roughness from the rough roll. Optionally, small micro-peaks randomly scattered over the surface can remain. The finish can be generated at high speed and with normal pass reductions in a cold mill.

In some embodiments, the surfaces described herein can be prepared according to a series of steps as described herein. The modified surfaces are characterized herein by various parameters, including Ra and Rz, which are measured in micrometers (microns) and are known to those of skill in the art. Optionally, the parameters can be measured using the MountainsMap® Surface Imaging and Metrology software (Digital Surf; Besancon, France). All roughness values can be mechanically measured with a standard stylus. An unfinished work roll is used for preparing the roll having the finish described herein. Unfinished work rolls appropriate for use can be obtained from a commercial source, such as, for example, Steinhoff GmbH & Cie. OHG (Dinslaken, Germany) and Union Electric Steel BVBA (Lummen, Belgium). The unfinished work roll can be a metal roll, such as, for example, a steel work roll. Optionally, the unfinished work roll is a smooth work roll that does not contain any scratch marks.

Grinding Step

The unfinished work roll is then ground, using a grit wheel, to form a ground work roll. The unfinished work roll is ground until a target roughness is achieved. The target roughness after the grinding step can be characterized by an Ra of 0.2 μm or less. For example, the target roughness in Ra after the grinding step can be 0.19 μm or less, 0.18 μm or less, 0.17 μm or less, 0.16 μm or less, or 0.15 μm or less. The target roughness after the grinding step can be characterized by an Rz of 2.00 μm or less. For example, the target roughness in Rz after the grinding step can be 1.80 μm or less, 1.60 μm or less, 1.40 μm or less, 1.20 μm or less, or 1.00 μm or less. Suitable grit wheels for achieving the target roughness in the work roll include 360 and below grit wheels. For example, suitable grit wheels include a 360 grit wheel, a 320 grit wheel, a 280 grit wheel, a 220 grit wheel, and a 180 grit wheel.

Superfinishing Step

The ground work roll is then polished, using a superfinisher, to achieve an Ra of less than 0.015 μm and an Rz of less than 0.25 μm. For example, the Ra of the work roll after the superfinishing step can be 0.014 μm, 0.013 μm, 0.012 μm, 0.011 μm, 0.010 μm, 0.009 μm, 0.008 μm, 0.007 μm, 0.006 μm, 0.005 μm, 0.004 μm, 0.003 μm, 0.002 μm, or 0.001 μm. The Rz of the work roll after the superfinishing step can be less than 0.20 μm, less than 0.15 μm, less than 0.10 μm, or less than 0.05 μm. Suitable superfinishers include the Loser Model SF 100 (Waldemar Loser KG Machinenfabrik; Speyer, Germany) or a GEM 04150-M or 08150-C Superfinisher commercially available from Grinding Equipment & Machinery Co. (Youngstown, Ohio). Following the superfinishing step, the surface of the roll can have a mirror-like appearance.

Roughening of the Roll

The roll can then be uniformly roughened to achieve an Ra of from 0.35 μm to 0.45 μm and an Rz of less than 5 μm.

For example, the Ra can be 0.45 μm, 0.44 μm, 0.43 μm, 0.42 μm, 0.41 μm, 0.40 μm, 0.39 μm, 0.38 μm, 0.37 μm, 0.36 μm, or 0.35 μm. The Rz of the roll following the roughening process can be less than 5 μm (e.g., less than 4.8 μm, less than 4.6 μm, less than 4.4 μm, less than 4.2 μm, less than 4.0 μm, less than 3.8 μm, less than 3.6 μm, less than 3.4 μm, less than 3.2 μm, or less than 3.0 μm). The roughening step can be performed using a grit blaster. Optionally, the grit blaster can include a 220 grit containing $Al_2O_3$ particles. In some examples, the preferred grit application and exhaust pressure and differential is from 2.5 bar to 4.5 bar. The roughening step can optionally be performed using a shot peening method. As used herein, shot peening refers to impacting the surface of the roll with particles using sufficient force to roughen the surface.

Final Finishing of the Roll

The roughened roll can then be finished using a polisher. Optionally, a 9 μm graded abrasive film polishing band is used to polish the roughened roll. The polisher can be passed over the roll up to four times (e.g., 1 time, 2 times, 3 times, or 4 times) until the desired Ra and Rz values are achieved. The roll after the finishing step can have an Ra of from 0.2 μm to 0.4 μm (e.g., from 0.22 μm to 0.37 μm, 0.25 μm to 0.35 μm, or from 0.27 μm to 0.3 μm). For example, the finished roll can have an Ra of 0.2 μm, 0.21 μm, 0.22 μm, 0.23 μm, 0.24 μm, 0.25 μm, 0.26 μm, 0.27 μm, 0.28 μm, 0.29 μm, 0.30 μm, 0.31 μm 0.32 μm, 0.33 μm, 0.34 μm, 0.35 μm, 0.36 μm, 0.37 μm, 0.38 μm, 0.39 μm, or 0.40 μm). The Rz of the finished roll can be below 3μm (e.g., below 2.5 μm). For example, the Rz of the finished roll can be below 3μm, below 2.9 μm, below 2.8 μm, below 2.7 μm, below 2.6 μm, below 2.5 μm, below 2.4 μm, below 2.3 μm, below 2.2 μm, below 2.1 μm, or below 2.0 μm. Optionally, a single use film polishing band is used to polish the roughened roll. In some examples, a continuously rotating belt polisher or grinder is not used.

The roll can be used in a mill to produce the finish as described herein. Optionally, one or both sides of the roll can be treated. For example, one or both sides of the roll can be treated using one or more of the following steps: texturing, controlled surface modification, media blasting, chrome coating, and embossing. The final finished roll can be analyzed using a Gardner Gloss meter as described in Example 1. The work roll as described herein (i.e., the final roll) can then be used for rolling processes, including cold rolling. For example, the final roll can be used in a mill that includes a cold roll step. Optionally, multiple work rolls as described herein can be used in a mill. For example, two work rolls as described herein can be used to simultaneously or tandemly finish both sides of a metal substrate.

Dulled Gloss Finish Products

Metal substrates can be cold rolled using the work rolls described herein to prepare products having a dulled gloss finish. Optionally, the metal substrate can be an aluminum or aluminum alloy sheet. Optionally, the metal substrate can be a steel sheet. For example, the aluminum alloys can be alloys from the 1000, 3000, or 5000 alloy families according to the Aluminum Association Register.

The dulled gloss finish described herein is suitable for any product that would benefit from a dulled gloss finish lacking strong directionality and having limited surface peaks (e.g., litho applications, can applications, and lacquer applications). For example, the dulled gloss finish described herein can be suitable for can ends, reflectors, painted and laminated products, signage, transportation, anodizing quality, and decorative finishes. In one embodiment, the can end is the end of a beverage can. An advantage of this finish is that there is a potential for saving coating weights since the roughness peak volumes are reduced for a similar average transverse roughness. Optionally, the dulled gloss finish described herein can be suitable for aesthetic applications, including for electronics (e.g., external surfaces of electronics) and for other applications where visual reflection is desired. Exemplary electronics suitable for the dulled gloss finish include computers, cell phones, automobiles, notepads, and the like.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

EXAMPLE 1

Reflection measurements and confocal microscopy were used to generate quantitative data from the following three finishes: bright rolled finish, standard grit finish, and the dulled gloss finish (DGF) described herein. The data were analyzed to detect parameters that numerically distinguish the DGF finish from the other surface finishes. The visual appearance of the DGF finish is of a satin like gloss with minimal directionality, and significantly different from the usual rolled grit finish.

Experimental:

Material was taken from the dulled gloss finish production series and compared to both bright rolled surfaces and traditionally rolled surfaces on similar products.

The dulled gloss finish (DGF) has been applied to AA1050 (as litho) and AA5182 (as Can End) alloys on whole coils with satisfactory uniformity and repeatability. Other 3000 series alloys have also been successfully rolled as warm-up coils, without having taken any samples.

One finish that was produced was a mixture of a grit finish with the DGF overlaid. This finish provided the dull sheen appearance, but was visually considered to be too directional, almost like the normal grit finish, and thus was declared unsatisfactory for product use.

The material was at first analyzed with a Gardner Gloss meter at 20°, 60° and 85° angles. The gloss measurement procedure adequately indicates reflectivity differences for metals.

A sample of each surface was then analyzed with a Nanofocus confocal microscope to generate a height distribution of a representative surface area from which numerical surface parameters were generated.

Confocal Analysis Methodology

A 20× objective was used, giving a surface area of 0.8 mm×0.8 mm for analysis. The raw measured surface data contained form and waviness components which had to be removed. There is no standardized way for doing this on generalized 3D surfaces, and the procedure applied was as follows: form removal by 2nd order polynomial, calculated for each surface individually (this removes any general large scale surface curvature); waviness removal by applying a robust Gaussian filter with cut off at 0.08 mm, and with edge management so that the resulting area was still 0.8×0.8 $mm^2$ (this removes the smaller scale waves or undulations such that a flat roughness surface is left). This is the surface used to compare to the equivalent rolled-grit or high-gloss roughness surface.

The resulting roughness surface may still contain individual extreme excursions caused by the measurement technique or dust, etc. These were removed by applying a threshold such that any upper and lower excursions were removed approximately symmetrically about the median height level leaving a 2μm range of each sample for analysis. This was adequate for all the surfaces studied without having any significant feature removed. The points outside the thresholds were set as "missing data".

Results

Optical Property Measurement

To measure distinctiveness (clarity) of image, the standard gloss measurement was used in both parallel and transverse orientations to the rolling direction. This indicates a difference in reflectance, and hence an indication of a) "glossiness" and b) anisotropy. The effect varies with angle of incidence, so all three standard gloss measuring angles were used (20°, 60°, 85°). The gloss results for the variants are given in Table 1 below.

TABLE 1

| Sample | Alloy (AA) | 20° parallel | 20° transverse | 60° parallel | 60° transverse | 85° parallel | 85° transverse |
|---|---|---|---|---|---|---|---|
| Bresso bright finish | 1050 | 1417 | 1409 | 717 | 702 | 127 | 129 |
| DGF 2009 12 | 1050 | 864 | 748 | 691 | 600 | 131 | 126 |
| DGF 2011 07a | 1050 | 833 | 682 | 728 | 583 | 135 | 130 |
| DGF CES 2012 06 a | 5182 | 964 | 868 | 638 | 586 | 123 | 126 |
| DGE 2009 10 | 1050 | 365 | 239 | 585 | 350 | 131 | 110 |
| Rolled Grit CES 2011 07 | 1050 | 337 | 187 | 516 | 199 | 129 | 72.3 |
| Rolled Grit CES Backside | 5182 | 295 | 162 | 487 | 186 | 121 | 86.3 |

Confocal Microscopy Measurement

The confocal microscope surfaces generated the following data which was analyzed with the MountainsMap SARL Digital Surf software package (Besancon, France) using methods either commonly accepted or adhering to the ISO standards. The confocally evaluated surface parameters after 2 μm thresholding are shown in Table 2.

TABLE 2

| Sample | Isotropy (%) | Sa (μm) | Sku (-) | Projected area (%) above 50% height | Projected area (%) between 25-50% height | No. of Motif Peaks |
|---|---|---|---|---|---|---|
| Bresso bright finish | 33.3 | 0.03 | 24.3 | 10.7 | 89.2 | 122 |
| DGF 2009 12 | 20.6 | 0.055 | 7.2 | 3.21 | 96.6 | 112 |
| DGF 2011 07 a | 22.2 | 0.056 | 7.24 | 6.17 | 91.1 | 473 |
| DGF 2011 07 b | 25 | 0.055 | 8.12 | 0.79 | 98.8 | 210 |
| DGF CES 2012 06 a | 24 | 0.055 | 10.3 | 0.91 | 98.6 | 418 |
| DGF CES 2012 06 b | 20 | 0.056 | 10.1 | 1.3 | 98.3 | 359 |
| DGE 2009 10 | 2.75 | 0.105 | 5.25 | 16.2 | 83.5 | 120 |
| Rolled Grit CES 2011 07 | 2.08 | 0.185 | 5.36 | 14.5 | 79.4 | 203 |
| Rolled Grit CES Backside | 1.56 | 0.152 | 6.22 | 18 | 80.4 | 325 |
| Rolled Grit CES 2012 06 | 1.95 | 0.185 | 4.47 | 17 | 77 | 399 |

The isotropy function was zero for totally directional surface, and 100% for an isotropic surface. The parameter was generated from the surface FFT with thresholds of 5% (low) and 50% (high).

Sa and Sku are as defined in International Organization for Standardization (ISO) Standards 2517-28, and the projected areas are from a slice through the surface at two height positions, arbitrarily chosen as quartiles, 25% and 50% up from zero.

The motif maxima were taken from a waterfall analysis of the 3D data assuming that points within 15% height threshold belong together.

Due to the differing surface structures, the motif numbers cannot be compared between the different categories.

Discussion

Optical Properties

Figure 3:
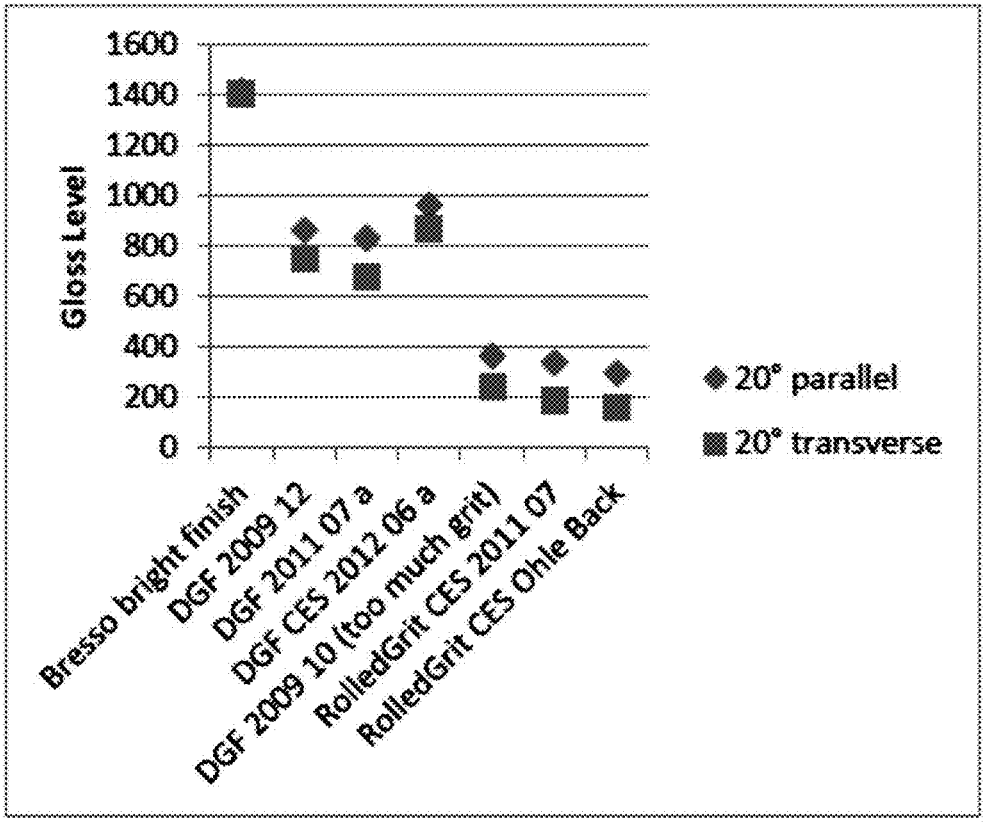
FIG. 3 is a graph showing the 20° gloss levels of the bright rolled finish, the dulled gloss finish (DGF), and the standard grit finish samples. "CES" refers to can end stock.

The 20° gloss level shows that the finish lies between high gloss and standard grit, both parallel and transverse to the rolling direction (see FIG. 3). DGF 2009 10, which is the DGF sample with visibly too much rolling grit in its background behaves as the standard grit samples, which fits to a visual judgment.

Figure 4:
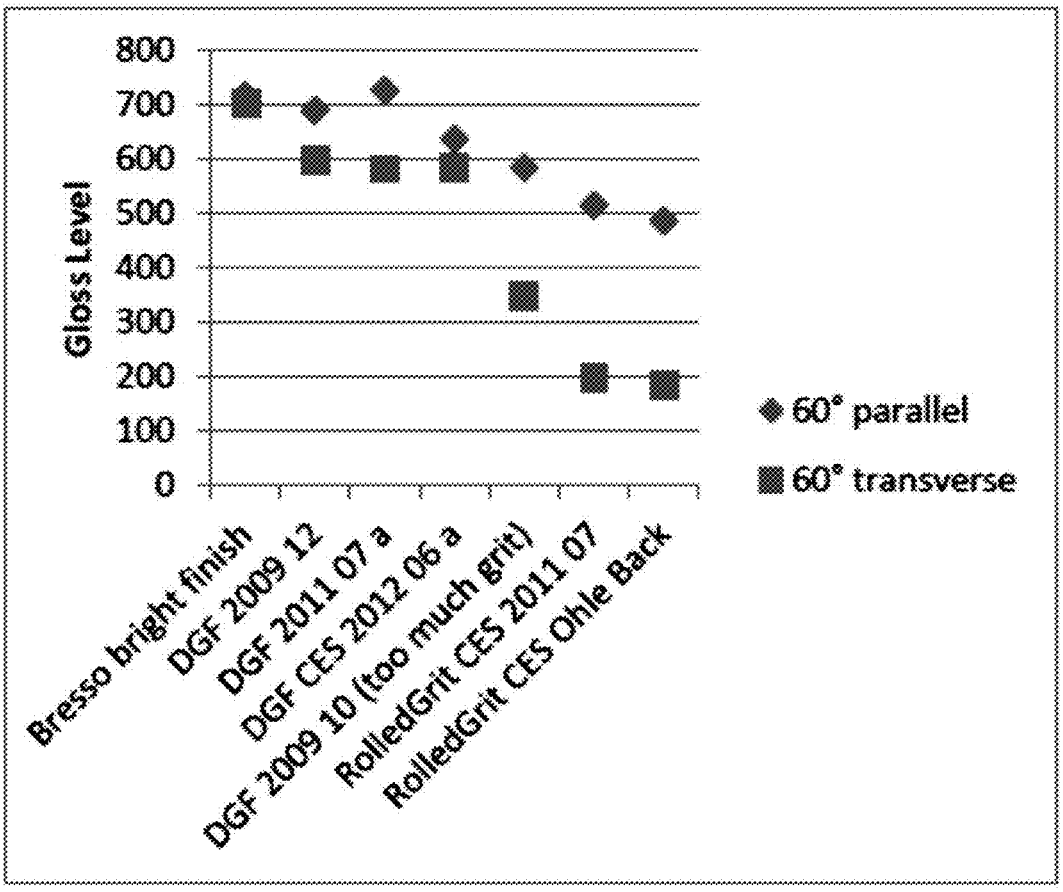
FIG. 4 is a graph showing the 60° gloss levels of the bright rolled finish, the dulled gloss finish (DGF), and the standard grit finish samples.
Figure 5:
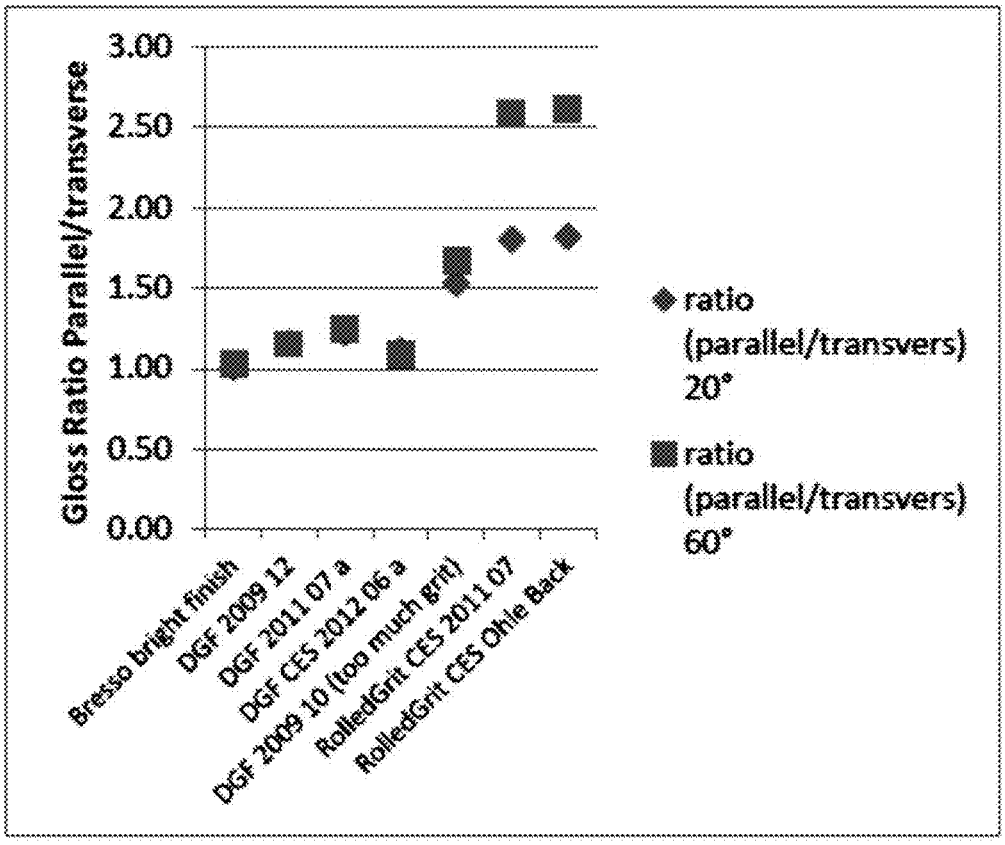
FIG. 5 is a graph of the ratio of directions for the 20° and 60° gloss readings of the bright rolled finish, the dulled gloss finish (DGF), and the standard grit finish samples.

The values at 60° angle are shown in FIG. 4. The anisotropy of the standard grit finish is seen to be much more than that of the DGF whereas the bright finish is effectively isotropic in gloss. FIG. 5, showing the ratio of the directions, also demonstrates this.

FIG. 5 shows that the DGF is behaving isotropically, like the bright finish, with ratios near 1 and below 1.5, whereas the grit finishes are strongly isotropic. The grit finish with DGF on top is behaving between that of a bright sheet and that of a normal can finish. The 60° in particular for this surface is not as anisotropic as the true grit finish.

Figure 6:
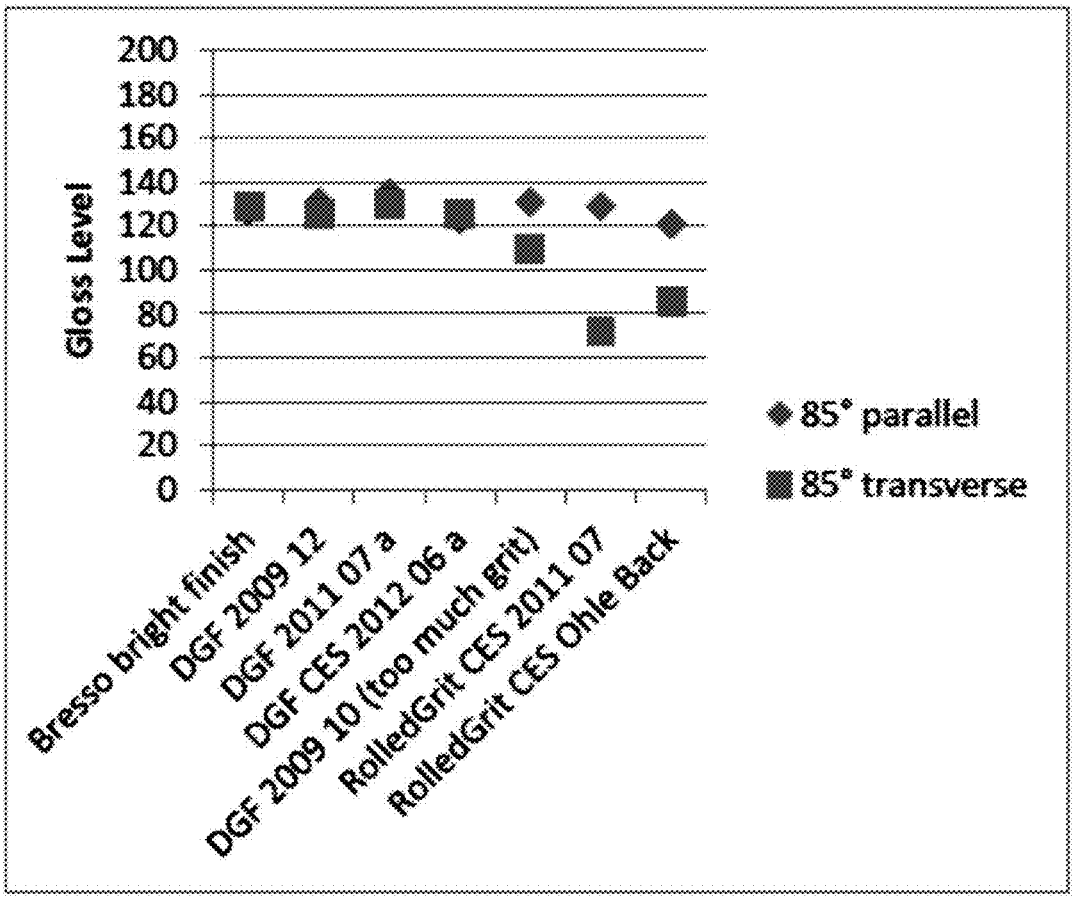
FIG. 6 is a graph showing the 85° gloss levels of the bright rolled finish, the dulled gloss finish (DGF), and the standard grit finish samples.

This comes out clearly at 85°, where the anisotropy of the rolled grit finishes is still large, whereas the DGF on grit is nearer the true DGF finish level without anisotropy (see FIG. 6).

Confocal Microscopy Parameters

Figure 7:
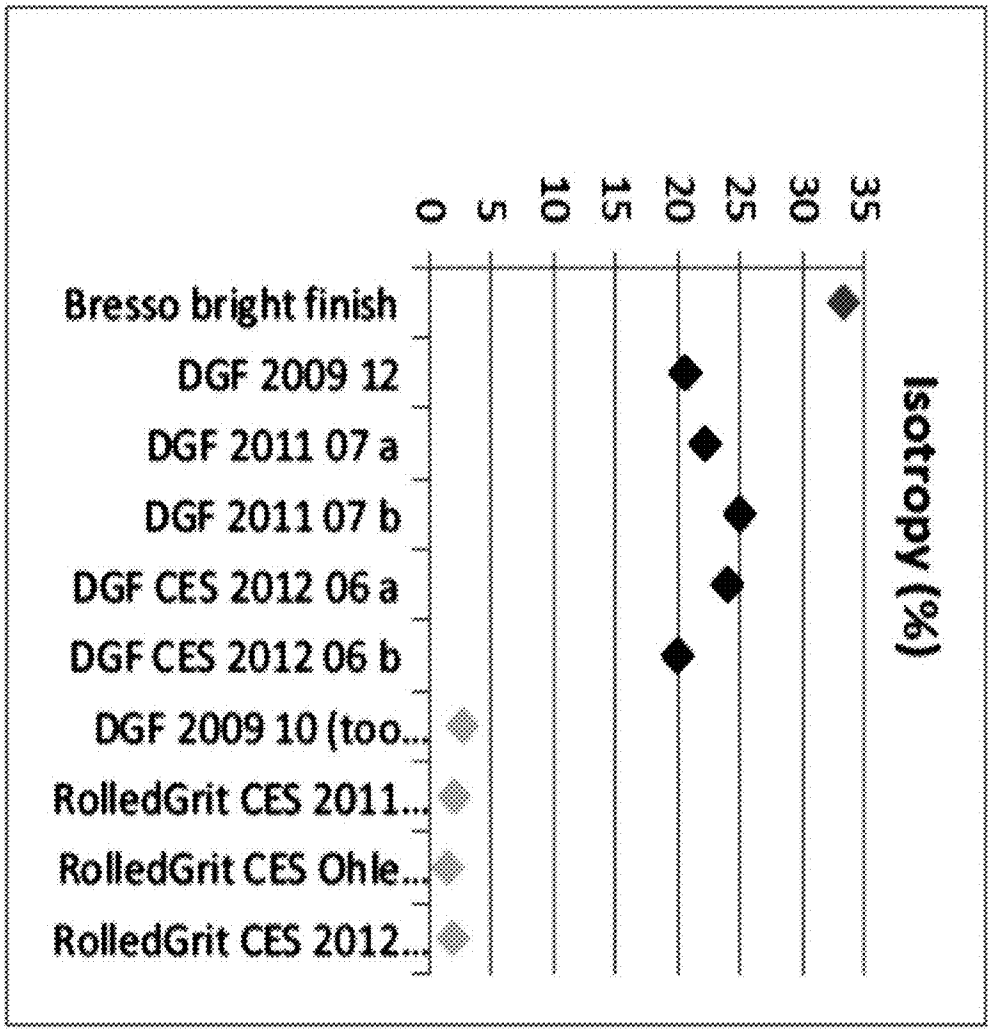
FIG. 7 is a graph showing the confocal image calculations of surface isotropy for surfaces from the bright rolled finish, the dulled gloss finish (DGF), and the standard grit finish samples.
Figure 8:
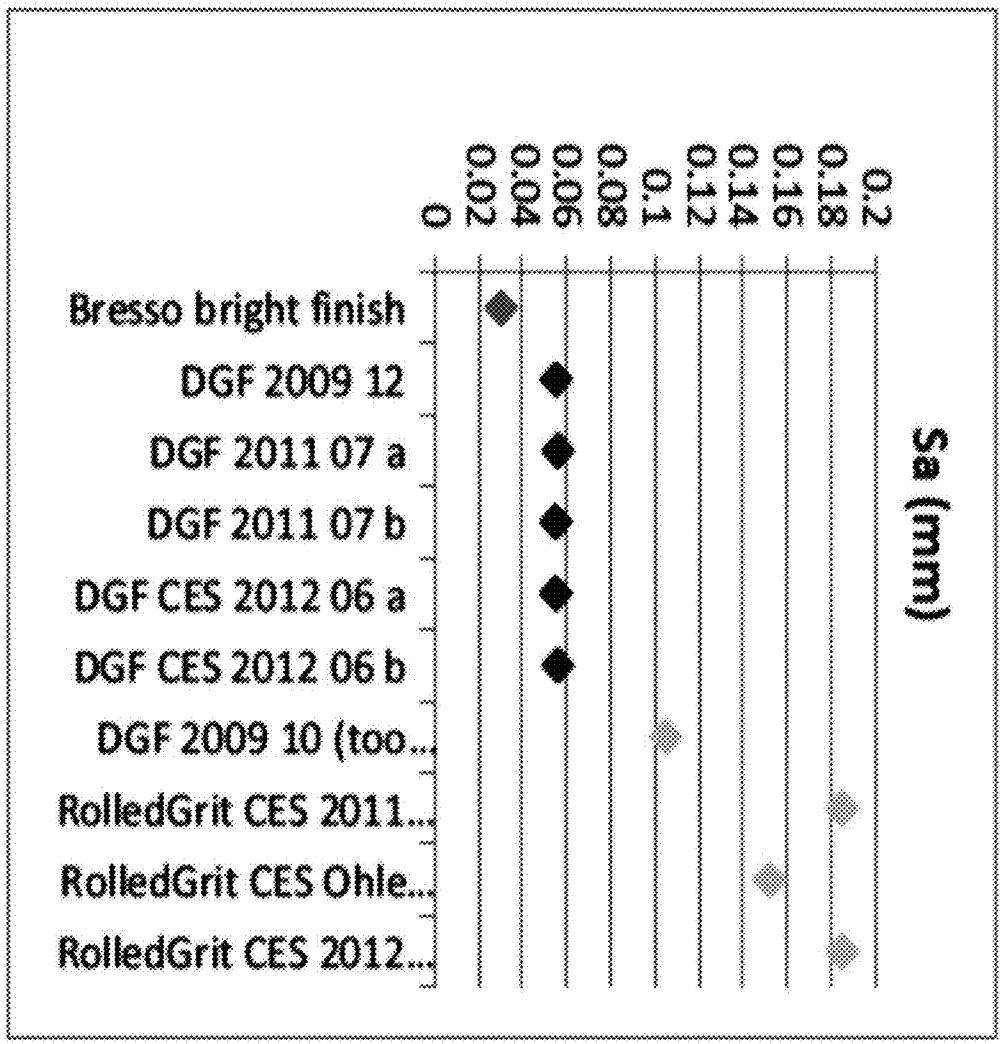
FIG. 8 is a graph showing the mean roughness (Sa) of the surfaces from the bright rolled finish, the dulled gloss finish (DGF), and the standard grit finish samples.

The calculated isotropy of the surfaces is shown in FIG. 7. The difference between the 3 classes of bright, DGF, and rolled grit are clear, as they are in FIG. 8 for the average roughness (Sa) of the surfaces.

Figure 9:
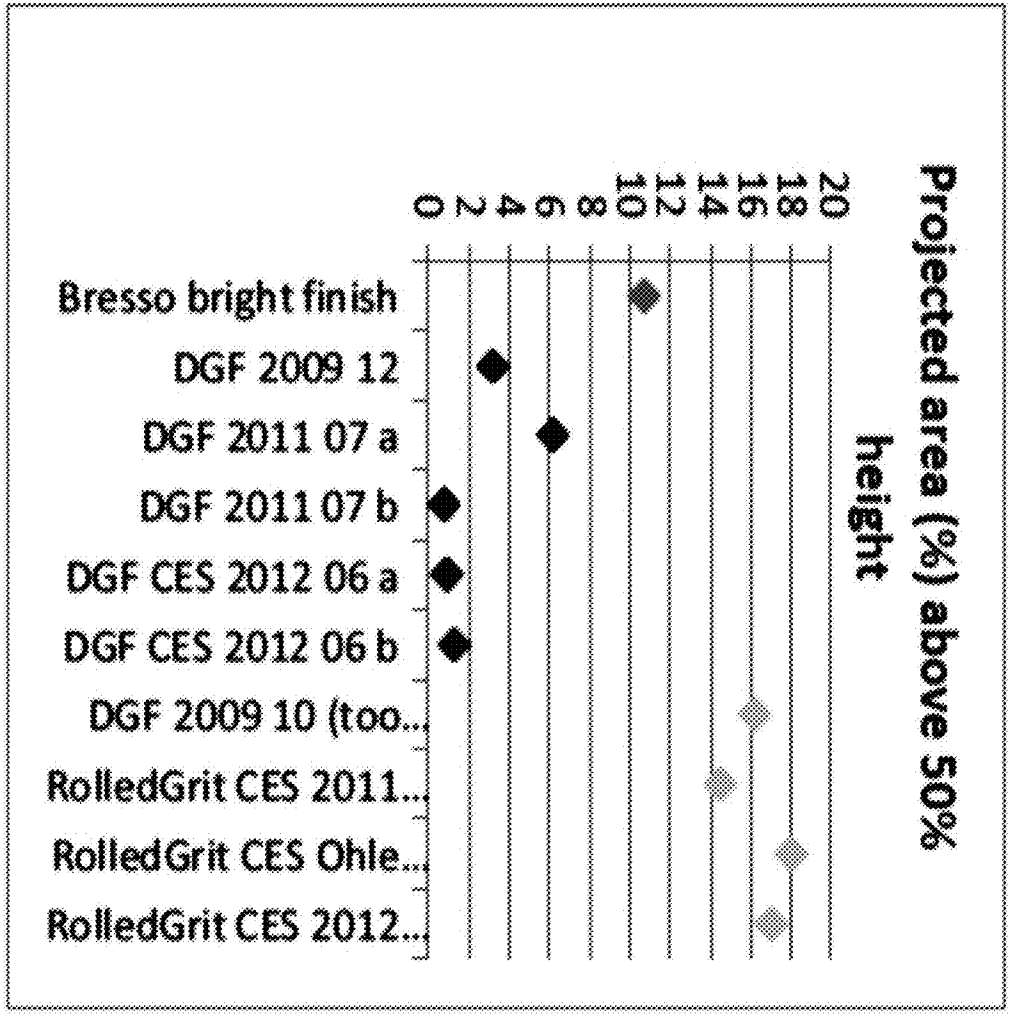
FIG. 9 is a depiction of the second quartile area (i.e., the projected areas above 50% height) for the bright rolled finish, the dulled gloss finish (DGF), and the standard grit finish samples.
Figure 10:
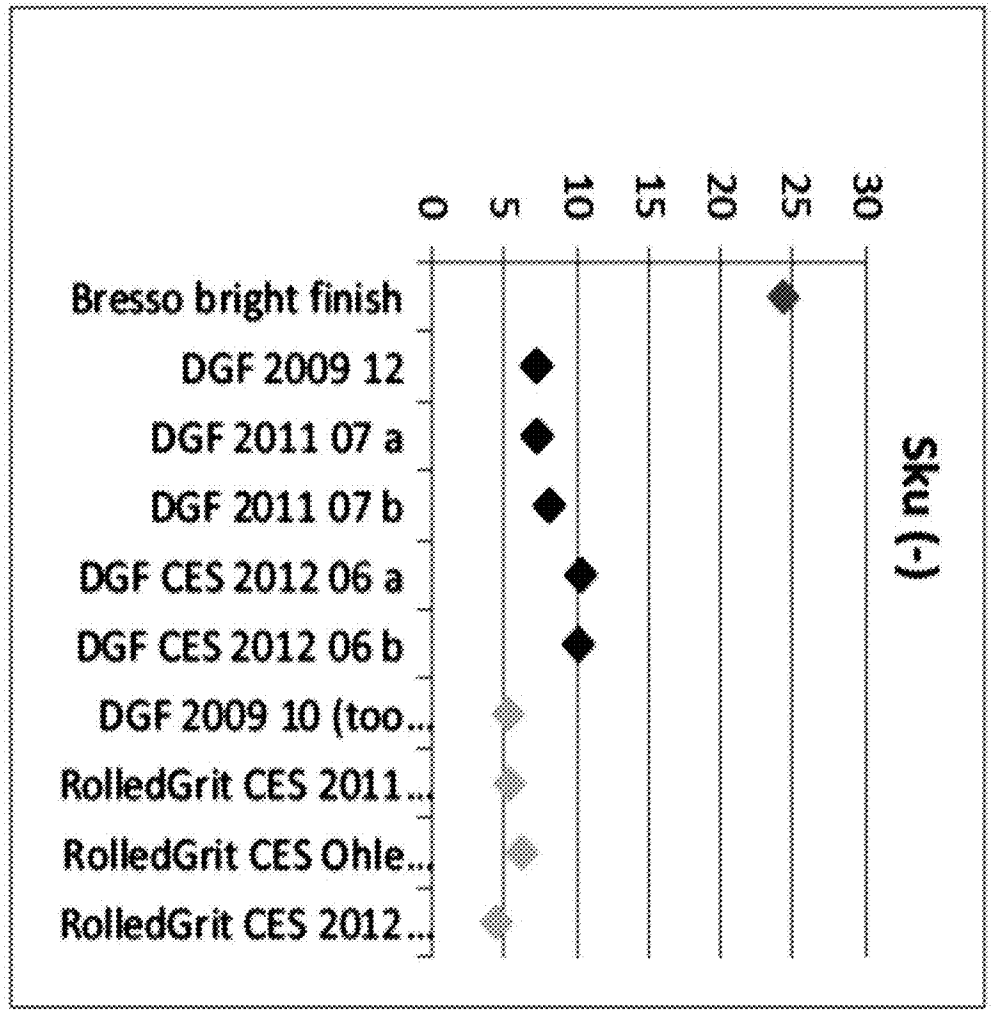
FIG. 10 is a depiction of the surface height kurtosis for the bright rolled finish, the dulled gloss finish (DGF), and the standard grit finish samples.
Figure 11:
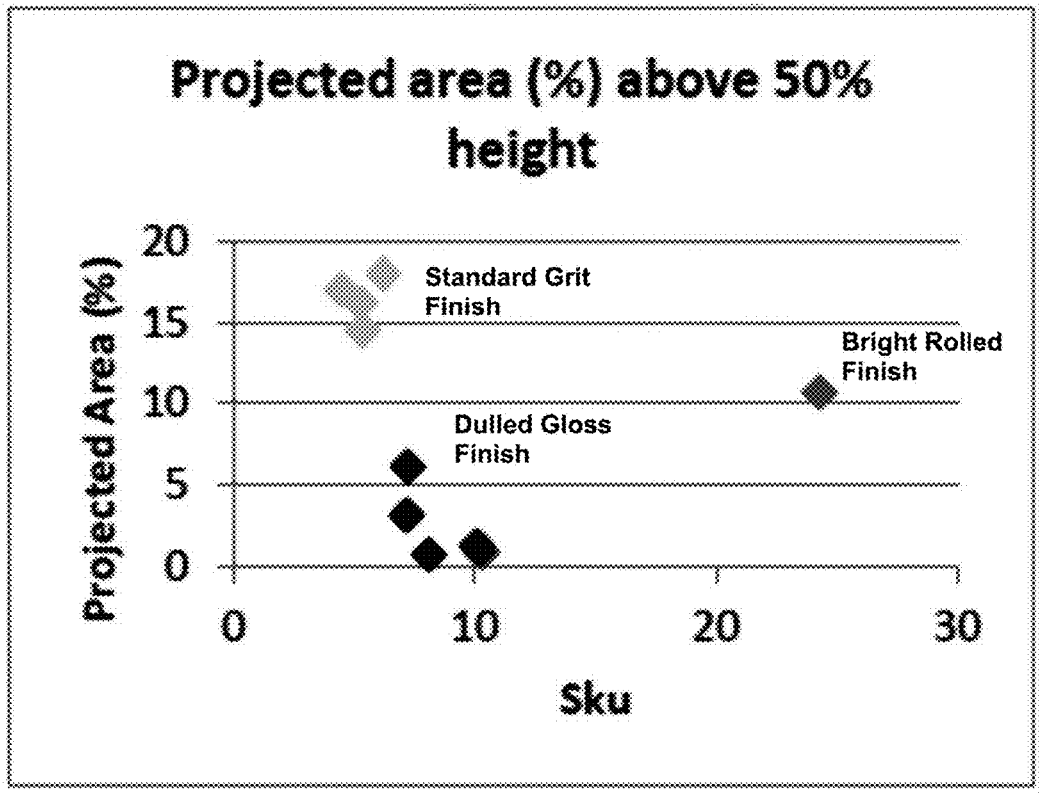
FIG. 11 is a graph showing the second quartile area against surface height distribution kurtosis for the standard grit finish samples (left four diamonds above 10% projected area), the dulled gloss finish (DGF) samples (middle four diamonds below 6% projected area), and the bright rolled finish sample (right diamond between 10% and 11% projected area).
Figure 12:
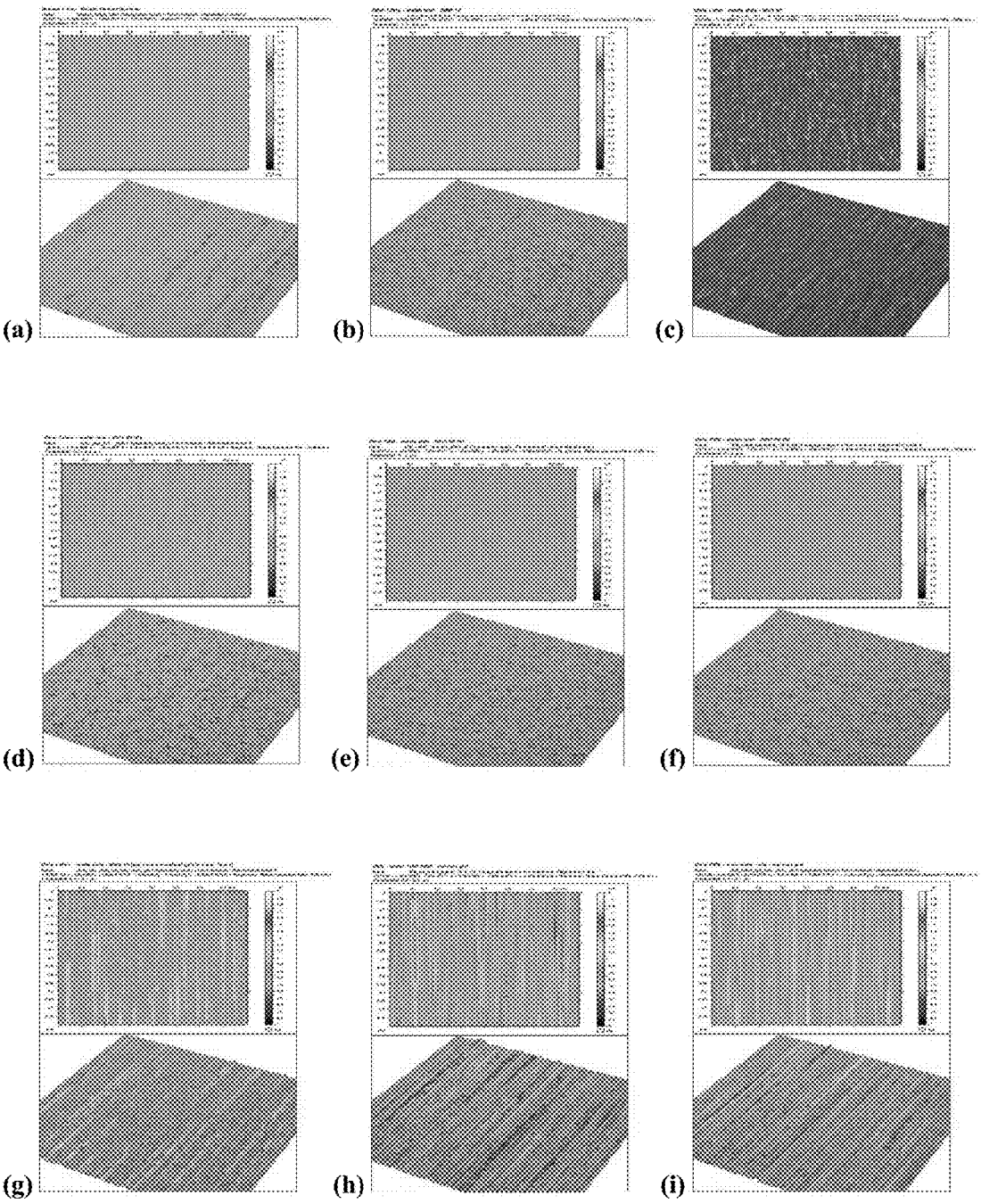
FIG. 12 contains panels showing confocal images of the samples. Panel (a) shows the bright finish; panel (b) shows DGF 2009 12; panel (c) shows DGF 2011 07 a; panel (d) shows DGF 2011 07 b; panel (e) shows DGF CES 2012 06 a; panel (f) shows DGF CES 2012 06 b; panel (g) shows DGF 2009 10; panel (h) shows Rolled Grit Can End Stock (CES) 2011 07; and panel (i) shows Rolled Grit CES Backside.

The projected areas at the quartile positions give an indication of the material distribution over the surface. The Sku parameter is a similar parameter based on the width of the assumed normal distribution of the heights. These are shown in FIGS. 9 and 10, respectively. Depicting both of these together leads shows a clearer separation, as is shown in FIG. 11. In FIG. 11, the data points between 0 and 10 Sku and between 14-20% in projected area correspond to the rolled grit finish; the data points between 5 and 11 Sku and between 0 and 7% in projected area correspond to the trial surface, and the data point between 20 and 30 Sku and between 10 and 13% in projected area corresponds to the bright finish. These data demonstrate that the trial finish exhibits a flattish bottom with a peaky top surface. Confocal images of the samples are shown in FIG. 12.

CONCLUSIONS

There are measurable differences between the bright finish, rolled grit finish, and the new DGF finish that can be quantified. The 20° gloss lies between 500 and 1100 units, well separated from both rolled grit and bright finish. At 60° the gloss anisotropy is half that of rolled grit, and still separated in the transverse direction by >=200 units. The ratio of parallel to transverse gloss at both 20° and 60° angles is well below 1.5, whereas grit finish is well above this. At 85° incidence, the DGF appears isotropic, like bright finish, whereas the rolled grit finish is still anisotropic. Confocal microscopy shows the surface frequency based isotropy to lie between 15% and 30%. Bright finish is over 30% and grit finish below 5%. The Sa of the roughness surface shows DGF to be similar to bright and around 0.05 mm, well away from the grit finished applied. The Sku and projected area above 50% height parameters are best judged against each other, giving clear boundary regions for the 3 surfaces.

All patents, publications and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the present invention as defined in the following claims.

The invention claimed is:

1. A method of preparing a work roll for applying a dulled gloss finish on a metal substrate surface, comprising:

(a) roughening an unfinished work roll surface to form a roughened work roll surface, wherein the roughened work roll has an Ra of 0.20 μm or less and an Rz of 2.00 μm or less;

(b) polishing the roughened work roll surface to form a polished work roll surface having an Ra of less than 0.015 μm and an Rz of less than 0.25 μm;

(c) uniformly roughening the polished work roll surface to form a uniformly roughened work roll surface having an Ra of from 0.35 μm to 0.45 μm and an Rz of less than 5 μm; and (d) finishing the uniformly roughened work roll surface to form a work roll surface, wherein the work roll surface has an Ra value of from 0.2 to 0.4 μm and an Rz value of less than 3.0 μm.

2. The method of claim 1, further comprising treating one or both sides of the work roll.

3. The method of claim 2, wherein the treating comprises one or more of texturing, controlled surface modification, media blasting, chrome coating, and embossing.

4. The method of claim 1, wherein the work roll surface has an Ra value of from 0.22 μm to 0.37 μm.

5. The method of claim 1, wherein the work roll surface has an Ra value of from 0.25 μm to 0.35 μm.

6. The method of claim 1, wherein the work roll surface has an Rz value of less than 2.5 μm.

7. The method of claim 1, wherein the work roll surface has an Rz value of less than 2.0 μm.

8. A method of forming a dulled gloss finish on a metal substrate, comprising:

(a) roughening an unfinished work roll surface to form a roughened work roll surface, wherein the roughened work roll has an Ra of 0.20 μm or less and an Rz of 2.00 μm or less;

(b) polishing the roughened work roll surface to form a polished work roll surface having an Ra of less than 0.015 μm and an Rz of less than 0.25 μm;

(c) uniformly roughening the polished work roll surface to form a uniformly roughened work roll surface having an Ra of from 0.35 μm to 0.45 μm and an Rz of less than 5 μm;

(d) finishing the uniformly roughened work roll surface to form a work roll surface, wherein the work roll surface has an Ra value of from 0.2 to 0.4 μm and an Rz value of less than 3.0 μm;

(e) inserting the work roll in a cold mill; and (f) cold rolling the metal substrate with the work roll to achieve the dulled gloss finish on the metal substrate.

9. The method of claim 8, further comprising treating one or both sides of the work roll after the finishing step.

10. The method of claim 9, wherein the treating comprises one or more of texturing, controlled surface modification, media blasting, chrome coating, and embossing.

11. The method of claim 8, wherein the metal substrate is aluminum or an aluminum alloy sheet.

12. The method of claim 8, wherein the work roll surface has an Ra value of from 0.22 μm to 0.37 μm.

13. The method of claim 8, wherein the work roll surface has an Ra value of from 0.25 μm to 0.35 μm.

14. The method of claim 8, wherein the work roll surface has an Rz value of less than 2.5 μm.

15. The method of claim 8, wherein the work roll surface has an Rz value of less than 2.0 μm.

* * * * *